US010845002B2

(12) United States Patent
Skovholt

(10) Patent No.: US 10,845,002 B2
(45) Date of Patent: Nov. 24, 2020

(54) LIQUID NATURAL GAS STORAGE TANK DESIGN

(71) Applicant: IC Technology AS, Trondheim (NO)

(72) Inventor: Otto Skovholt, Trondheim (NO)

(73) Assignee: IC TECHNOLOGY AS, Trondheim (NO)

( * ) Notice: Subject to any disclaimer, the term of this patent is extended or adjusted under 35 U.S.C. 154(b) by 148 days.

(21) Appl. No.: 16/074,672

(22) PCT Filed: Feb. 1, 2017

(86) PCT No.: PCT/NO2017/050027

§ 371 (c)(1),
(2) Date: Aug. 1, 2018

(87) PCT Pub. No.: WO2017/135826

PCT Pub. Date: Aug. 10, 2017

(65) Prior Publication Data

US 2019/0041002 A1 Feb. 7, 2019

(30) Foreign Application Priority Data

Feb. 2, 2016 (NO) ..... 20160159

(51) Int. Cl.
*B63B 25/16* (2006.01)
*F17C 1/00* (2006.01)
*F17C 1/12* (2006.01)

(52) U.S. Cl.
CPC ..... *F17C 1/002* (2013.01); *F17C 1/12* (2013.01); *F17C 2201/0157* (2013.01);
(Continued)

(58) Field of Classification Search
CPC ..... B63B 25/16; F17C 1/002; F17C 1/12
See application file for complete search history.

(56) References Cited

U.S. PATENT DOCUMENTS 3,076,317 A * 2/1963 La Fave ..... G11B 5/55 405/131
3,670,517 A 6/1972 Nonnecke
(Continued)

FOREIGN PATENT DOCUMENTS

CN 85105351 4/1987
CN 1786550 6/2006
(Continued)

OTHER PUBLICATIONS

International Search Report dated Jun. 23, 2017 in corresponding International Application No. PCT/NO2017/050027.
(Continued)

*Primary Examiner* — Stephen P Avila
(74) *Attorney, Agent, or Firm* — Wenderoth, Lind & Ponack, L.L.P.

(57) ABSTRACT

The present invention utilize a combination of wooden elements (20, 21), stainless steel membranes (22) and insulating materials in embodiments of the present invention. An object of the present invention is to be able to build the LNG tank separately from the building of the ship, and fit a complete or nearly complete LNG tank into the space of the ship hull when appropriate during the process of building the ship. Therefore, the building of the tank and the ship can be done in parallel, which by experience reduces the total time of building the ship considerably, and hence provide substantial cost savings.

17 Claims, 21 Drawing Sheets

(52) U.S. Cl.
CPC ..... *F17C 2201/052* (2013.01); *F17C 2203/0304* (2013.01); *F17C 2203/0329* (2013.01); *F17C 2203/0354* (2013.01); *F17C 2203/0358* (2013.01); *F17C 2203/0391* (2013.01); *F17C 2203/0626* (2013.01); *F17C 2203/0629* (2013.01); *F17C 2203/0643* (2013.01); *F17C 2221/033* (2013.01); *F17C 2223/0161* (2013.01); *F17C 2223/033* (2013.01); *F17C 2227/0337* (2013.01); *F17C 2227/0341* (2013.01); *F17C 2250/04* (2013.01); *F17C 2250/043* (2013.01); *F17C 2260/011* (2013.01); *F17C 2260/013* (2013.01); *F17C 2270/0107* (2013.01); *F17C 2270/0134* (2013.01)

(56) References Cited

U.S. PATENT DOCUMENTS

| | | | | |
|---|---|---|---|---|
| 3,719,302 | A * | 3/1973 | Hamilton | B63B 25/16 220/560.06 |
| 3,721,362 | A | 3/1973 | Bridges et al. | |
| 4,069,642 | A | 1/1978 | Hendriks | |
| 4,426,817 | A * | 1/1984 | Bomhard | F17C 3/04 52/262 |
| 5,177,919 | A * | 1/1993 | Dykmans | B65D 88/34 405/229 |
| 7,717,289 | B2 * | 5/2010 | Yang | F17C 1/002 220/560.07 |
| 2006/0096185 | A1 | 5/2006 | Dhellemmes et al. | |
| 2007/0186834 | A1 | 8/2007 | Jordan et al. | |
| 2015/0285439 | A1 | 10/2015 | Herry et al. | |

FOREIGN PATENT DOCUMENTS

| | | |
|---|---|---|
| CN | 101059202 | 10/2007 |
| CN | 10-2010-0124552 | 11/2010 |
| CN | 103615653 | 3/2014 |
| GB | 1054641 | 1/1967 |
| GB | 1179442 | 1/1970 |
| KR | 10-2012-0134596 | 12/2012 |
| WO | 2008/147003 | 12/2008 |
| WO | 2014/132661 | 9/2014 |

OTHER PUBLICATIONS

Norwegian Search Report dated Sep. 2, 2016 in corresponding Norwegian Application No. 20160159.
Kyo Kook Jin et at, "An Effect of Fluid-Structure Interaction for KC-1 Cargo Containment System under Sloshing Loads", Jun. 2015.
Pascale Grieve, "GST, A New Generation of LNG Membrane-Type Land Storage Tank", Feb. 25, 2010.
Office Action dated Feb. 3, 2020 in corresponding Chinese Application No. 201780014841.X (with English translation).

* cited by examiner

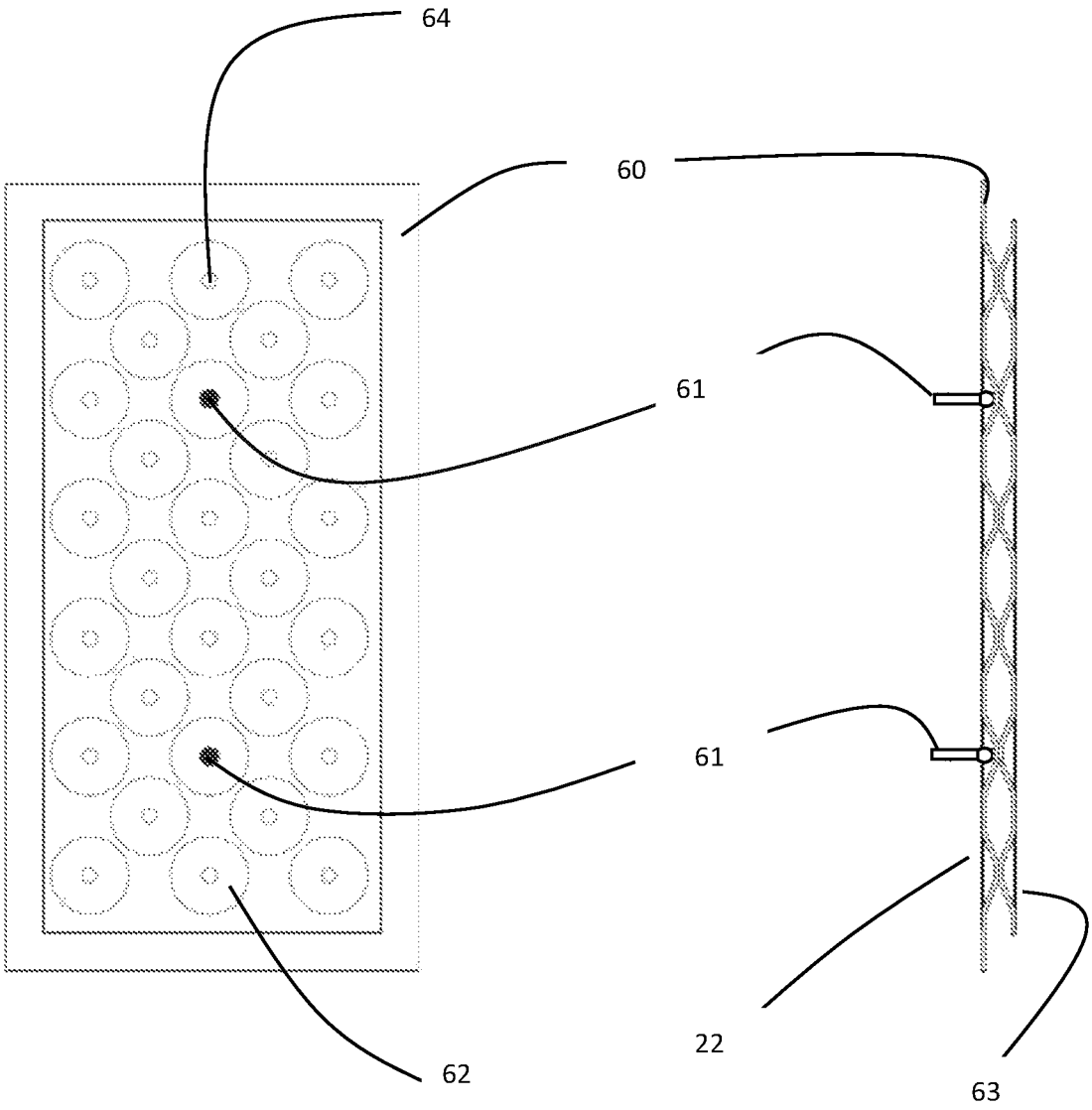
Figur 4a

LIQUID NATURAL GAS STORAGE TANK DESIGN

FIELD OF THE INVENTION

The present invention relates to a Liquid Natural Gas (LNG) storage tank design, and especially to a tank design comprising a support structure of wood elements carrying a plurality of double plated steel membrane elements, wherein steel plates of the respective double plated steel membrane elements are joined together face to face spaced apart providing an accessible space between the respective steel plates constituting a flexible leakage proof membrane of the LNG tank.

BACKGROUND OF THE INVENTION

Natural gas is a major energy source used in many industrial processes as well as supplying energy to households. The supply of gas to respective consumers requires an infrastructure that can distribute gas from offshore gas fields as well as land based fields. Enabling a balanced consumption of LNG in view of uneven production rates or distribution usually requires LNG storage tank facilities in between consumers and the supply from fields providing buffering of any variations in production rates or supply. A major problem when transporting and storing natural gas is the volume of the gas. Therefore, the volume is in general reduced by cooling the natural gas converting the gas to a liquefied phase around −165° C. The liquid volume is then only about 1/600 of the starting gas volume. Liquefied natural gas (LNG) is therefore a preferred phase when transporting and storing natural gas.

Storage and transport of liquefied LNG is a technical challenge not only due to the low temperature, but also due to safety issues.

The cryogenic temperature associated with LNG systems creates a number of safety considerations regarding bulk transfer and storage. Most importantly, LNG is a fuel that requires intensive monitoring and control because of the constant heating of the fuel, which takes place due to the extreme temperature differential between ambient and LNG fuel temperatures. Even with highly insulated tanks, there will always be a continuous build-up of internal pressure and a need to use for example a fuel vapour vent thereby safely venting vapour to the surrounding atmosphere. When transferring LNG in pipes, it is necessary to cool down the transfer pipelines in order to avoid forming excessive amounts of vapour.

Another consideration is that at low temperatures, many materials may undergo changes in their strength making them potentially unsafe for their intended use. For example, materials such as carbon steel lose ductility at low temperatures, and materials such as rubber and some plastics have a drastically reduced ductility and impact strength such that they may shatter into pieces when dropped, or when being subject to other external impact forces.

The standard ISO 12991:2012 disclose safety regulations related to LNG storage tanks on trucks. The standard specifies construction requirements of refillable fuel tanks for liquefied natural gas (LNG) used on vehicles as well as providing testing methods required to ensure that a reasonable level of protection from loss of life and property resulting from fire and/or explosions.

The European standard EN 14620, 1-5 provides design guidelines for vertical cylindrical storage tanks with flat bottoms for storage of LNG. There are rules regarding material properties and testing, certification of materials, etc.

Ship designs transporting LNG are subject to strict safety requirements. Ships must be built according to ship classifications rules allowing the ships to transport LNG. The International Maritime Organisation (IMO) has created a set of classes and rules related to different cryogenic tank designs used on board ships for transportation of liquefied cryogenic gasses.

One specific challenge with respect to transporting LNG on ships, is twisting of the ship hulls in many directions from waves when a ship moves through the sea. These movements may influence the tank walls of the LNG tanks on board the ship. Therefore, allowing some flexibility of the tank structure while at the same time keeping the leakage proof heat insulated walls intact is necessary. Steel is a preferred material used in constructions requiring structural integrity when in use.

However, repeated twisting of a steel element may lead to fatigue fracture of the steel element. Further, it is common to plan sailing routes of LNG transporting ships to avoid traveling through areas with harsh weather conditions.

Budding of vertical LNG tanks on land with a concrete outer wall supporting an inner steel tank, wherein insulation is provided in the space between the concrete wall and the inner steel tank, is known in the prior art. U.S. Pat. No. 4,069,642 by Hendriks et al from Jan. 24, 1978 disclose a vertical LNG tank design of this kind. The combination of concrete and steel provides advantages compared to tanks made only of steel. The concrete structure provides mechanical integrity of the walls while the steel wars provide the leakage proof membrane of the tank design. The mechanical integrity provided by the concrete wall member makes it possible to increase the height of a vertical LNG storage tank compared to plain steel tanks.

The French company GTT Technigaz has developed a range of LNG tank designs suitable for ships based on using a combination of plywood plates, corrugated steel plates and isolation materials. An example of their design in illustrated in FIG. 1.

The FIG. 1 and a more detailed description of the GTT technology is disclosed on the link http://www.gtt.fr/technologies-services/our-technologies/mark-v-system.

The main idea of the GTT design is to use walls of the ship hull as the supporting structure supporting an insulated leakage proof membrane. The tank wall is a sandwich construction of respective elements. The ship hull support directly plywood panels carrying an assembly of a first insulating layer supporting a layer with corrugated steel plates being welded together during assembly, followed by another insulating layer finalized with a second layer of corrugated steel plates being welded together during assembly of the GTT tank wall. The steel plates of the first and second layer are in direct contact with the insulating material. In order to provide sufficient surface contact between the steel plate surfaces and the insulating material the corrugations are located at the edges of the plates, and are shaped in a V like form around the square or rectangular flat shaped steel plates. The peak of the V shaped corrugation along one edge is then orthogonal to another V shaped edge along another adjacent edge, and all sides together forms a regular immersion with a flat bottom adapted to receive adapted insulating material elements. The V shaped edges are welded together thereby forming a section of the tank wall. The V shape is designed to mitigate effects of thermal induced stress in respective steel plates.

A consequence of the design methodology of the GTT technique is that the tank of the LNG carrying ship must be constructed at the same time the ship itself is built. This prolong the time of building the ship, which may result in significant increase of the cost. It would be beneficial to be able to build the tank with some of the beneficial aspects of the GTT tank design in parallel with the ship hull, or at least parts of the tank in parallel, and then fit the finished tank or parts of the tank into the hull at a proper time during the building process of the ship. This would reduce the building time considerably and hence the cost.

Although approved LNG tank designs are known in prior art, there seems to be specific different designs available for different application areas of the respective LNG tank designs. Despite the fact that any application area of LNG tanks faces many of the same technical challenges, LNG transport tanks on trucks are substantially different from vertical storage tanks on land while LNG storage tanks on ships are different form the other designs of other application areas.

Hence, an improved LNG storage tank design would be advantageous, that can be applied and adapted to different LNG storage tank applications and in particular, a more efficient and simpler LNG storage tank design would be advantageous.

It is further within the scope of the present invention that examples of embodiments of the improved LNG tank according to the present invention is usable when storing and/or transporting other cryogenic gases like methane, ethylene, propane etc.

OBJECT OF THE INVENTION

It is a further object of the present invention to provide an alternative to the prior art.

In particular, it may be seen as an object of the present invention to provide a LNG storage tank that can be fitted into an inner hull of an outer mechanical support structure, wherein the LNG storage tank can be built separately from the budding of the mechanical support structure, wherein the LNG storage tank comprises a wall part constituted by a plurality of wooden elements supporting a flexible leakage free double plated membrane comprising an accessible space in between the plates of the membrane made of corrugated steel plates,

SUMMARY OF THE INVENTION

Thus, the above described object and several other objects are intended to be obtained in a first aspect of the invention by providing a Liquid Natural Gas (LNG) storage tank fitted in a mechanical support structure like a LNG bulk carrier ship, comprising walls constituted by wooden wall elements, stainless steel membranes and insulating materials than can be assembled separately from the process of building a ship hosting the storage tank.

The invention is particularly, but not exclusively, advantageous for obtaining a Liquid Natural Gas (LNG) storage tank comprising an outer mechanical support structure providing a closed space housing a membrane wall of the LNG tank, wherein the membrane wall is constituted by at least the following constructional elements in order from the inner surface side of the outer mechanical support structure toward the interior storage space of the LNG storage tank:

a first end of a wooden spacer element is attached to the inner surface of the mechanical support structure, while a second end opposite the first end is attached to a backside of a wooden wall element, wherein a double plated membrane element is attached or located adjacent to a front side opposite the backside of the wooden wall element, wherein an outer surface of the double plated membrane element is facing towards the interior of the storage space of the LNG tank, the double plated membrane element is constituted by a first steel plate being arranged with a first plurality of protruding corrugation elements, and a second steel plate arranged with a second plurality of protruding corrugation elements, wherein the first steel plate is welded to the second steel plate face to face, wherein top points or top surfaces of the first plurality of protruding corrugation elements of the first steel plate is touching corresponding top points or top surfaces of the second plurality of corrugation elements of the second steel plate, wherein the welding is done by spot welding together a select number of touching top points or top surfaces of the first plurality of protruding corrugation elements of the first steel plate touching corresponding protruding corrugation elements of the second plurality of corrugation elements of the second steel plate, the membrane element is thereby arranged with an accessible space in between the respective first and second steel plates of a membrane element, a complete tank wall supported by the outer mechanical support structure is arranged by assembling a plurality of spacer elements supporting a plurality of continuously joined wooden wall elements supporting a plurality of continuously joined double plated membrane elements (22), thereby forming a closed leakage free storage space of the LNG tank.

Respective aspects of the present invention may each be combined with any of the other aspects. These and other aspects of the invention will be apparent from and elucidated with reference to the embodiments described herein.

DESCRIPTION OF THE FIGURES

The LNG storage tank according to the present invention will now be described in more detail with reference to the accompanying figures. The attached figures illustrate an example of embodiment of the present invention and is not to be construed as being limiting to other possible embodiments falling within the scope of the attached claim set.

FIG. 4*a* illustrates an example of embodiment of a membrane element according to the present invention.

FIG. 4*d* illustrates further details of the example in FIG. 4*a*.

DETAILED DESCRIPTION OF AN EMBODIMENT

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Further, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

Figure 1:
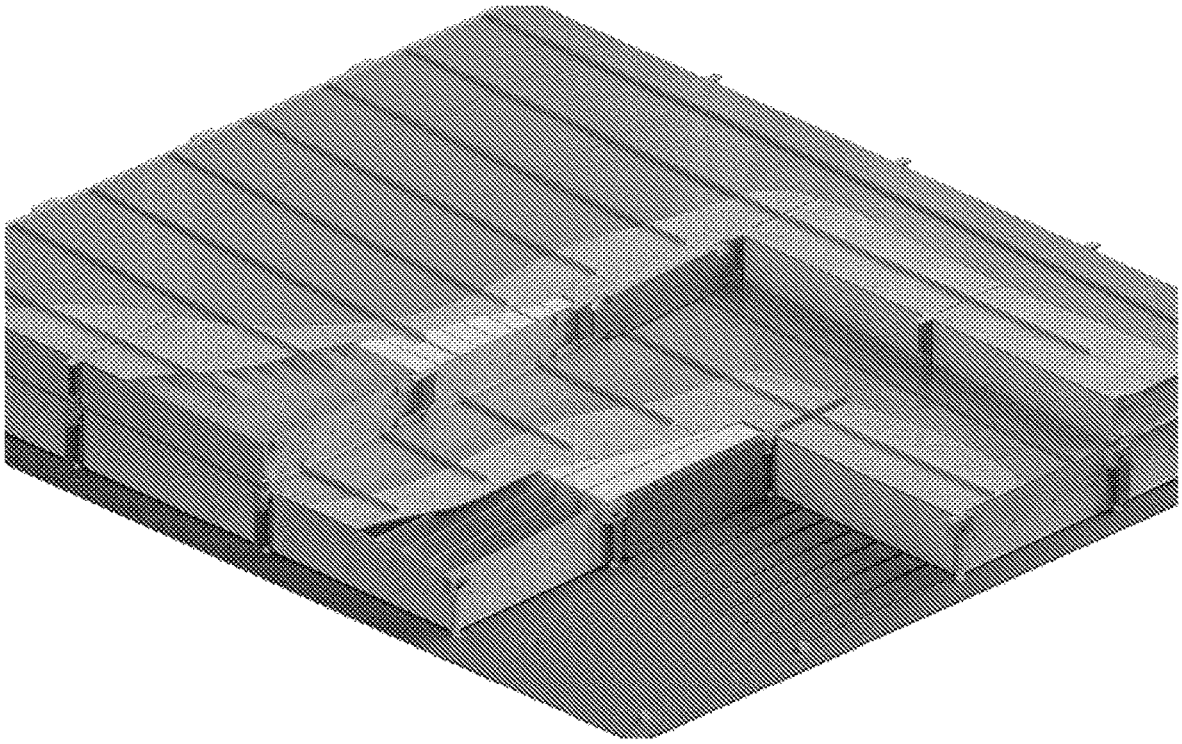
Figure 1 PRIOR ART
FIG. 1 illustrates an example of prior art.

The French company GTT Technigaz has developed a range of LNG tank designs suitable for ships, based on using a combination of plywood plates and corrugated steel plates and isolation materials. An example of their design in illustrated in FIG. 1. The system comprises modules assembled after the ship hull is bunt. A main idea is that a cryogenic liner is directly supported by the ship's inner hull. The liner is composed of metallic membranes including a primary membrane and a secondary membrane combined with prefabricated insulation panels. The system can be adapted to all sizes of LNG transporting ships.

The primary membrane is made of single corrugated stainless steel plates being fixed directly to a first insulation system. The secondary membrane is a single corrugated stainless steel plate directly connected to a second insulation system. The corrugations are a V shaped folding along the edges of the respective stainless steel plates.

The panels comprise plywood panels facing towards the ship hull sides and are attached to the inner hull side.

The design of the walls of the cited prior art LNG storage tank comprises in order: the ship hull side, a plywood panel, the second insulating system, the secondary membrane, the first insulation system and finally the primary membrane.

The use of the wood materials in the design provides a material that can withstand twisting movements of the ship hull much easier than any steel design. The corrugated steel plates make it possible to mitigate mechanical stress from the above discussed twisting of the ship hull as well as thermal induced stress, for example induced during filling and unloading LNG from the tank, or when LNG is stored in the tank.

The present invention uses a similar combination of materials as used in the above discussed prior art solution. However, an object of the present invention is to be able to build the LNG tank separately from the building of the ship, and fit a complete or nearly complete LNG tank into the space of the ship hull when appropriate during the process of building the ship. Therefore, the building of the tank, or at least parts of the tank, and the ship can be done in parallel, which by experience reduces the total time of building the ship considerably, and hence provides substantial cost savings. A beneficial effect of this aspect of a possibility to build walls of a LNG tank according to the present invention separately from a structure supporting or transporting the LNG tank, is that the LNG tank as such can easily be adapted to many different application areas comprising different support structures.

A consequence of the design according to the present invention, is that the present inventive LNG tank concept also can be used in land based LNG tank systems providing cost effective onshore storage of LNG.

Another unique feature of the present invention is that a LNG storage tank can be built into containers of standard format and design, which makes it easy to transport LNG since most of the transport infrastructure and machinery of the world trade transport system is adapted to the standardized form factors of containers as known in the prior art.

In all aspects of the present invention, an outer mechanical support structure, like a ship hull, a concrete wall of an onshore LNG storage tank, a container etc. is carrying or supporting an insulated double steel plated membrane. The membrane is spaced apart from the mechanical support structure by wooden spacer elements, wherein the double plated steel membrane is constituted by an assembly of a plurality of double plated membrane elements being attached or located adjacent to a wooden wall element being attached to the spacer elements. When the double plated membrane elements alternatively are arranged to be located adjacent to the wall elements, the double plated membrane elements are attached to bolts extending through the wooden wall element either all the way backwards to be attached to the outer mechanical support structure, or the bolts are attached to a spacer element in a position being located in between the inner wall of the outer mechanical support structure and the backside of the wooden wall element.

Figure 2:
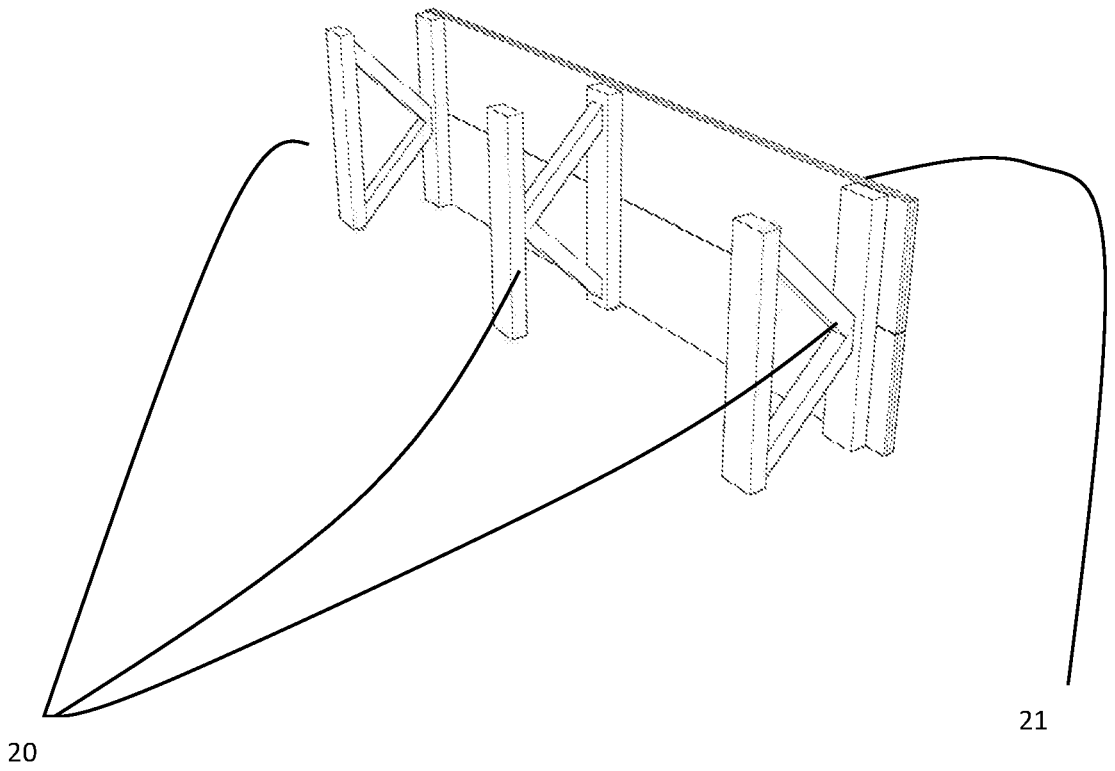
FIG. 2 illustrates details of an example of embodiment of the present invention.

FIG. 2 illustrates an example of a part of a wooden wall assembly of a LNG tank wall according to the present invention. Spacer elements 20 are intended to be facing towards the inner hull side of the mechanical support structure. In the example disclosed in FIG. 2 the spacer elements 20 are constituted by wooden carrying beams supported by trusses being attached to wooden beams supporting wooden wall elements 21 being part of the tank wall comprising the wooden wall assembly. The space between the mechanical support structure and the wooden wall part constituted by the spacer elements 20 may be filled with insulating materials. The length of the spacer elements may be of different length in different embodiments, thereby the volume of the space between the mechanical support structure and the wooden wall part may be varied enabling sufficient insulating properties of a specific tank design at the same time as maximum storage capacity of the tank can be preserved.

If the mechanical support structure for example is a ship hull, the spacer elements 20 are in contact with the inner surface of the ship hull. The outer dimension of the tank assembly according to the present invention may be provided slightly smaller than the actual dimensions of the space inside for example the ship hull, which facilitates lowering of the tank when fitted into the ship hull. This aspect facilitates the placement of the LNG tank. Afterwards wooden spacer elements as disclosed in FIG. 2 may be for example wedged or attached with brackets to be in firm contact with the inner side of the ship hull.

Figure 3A:
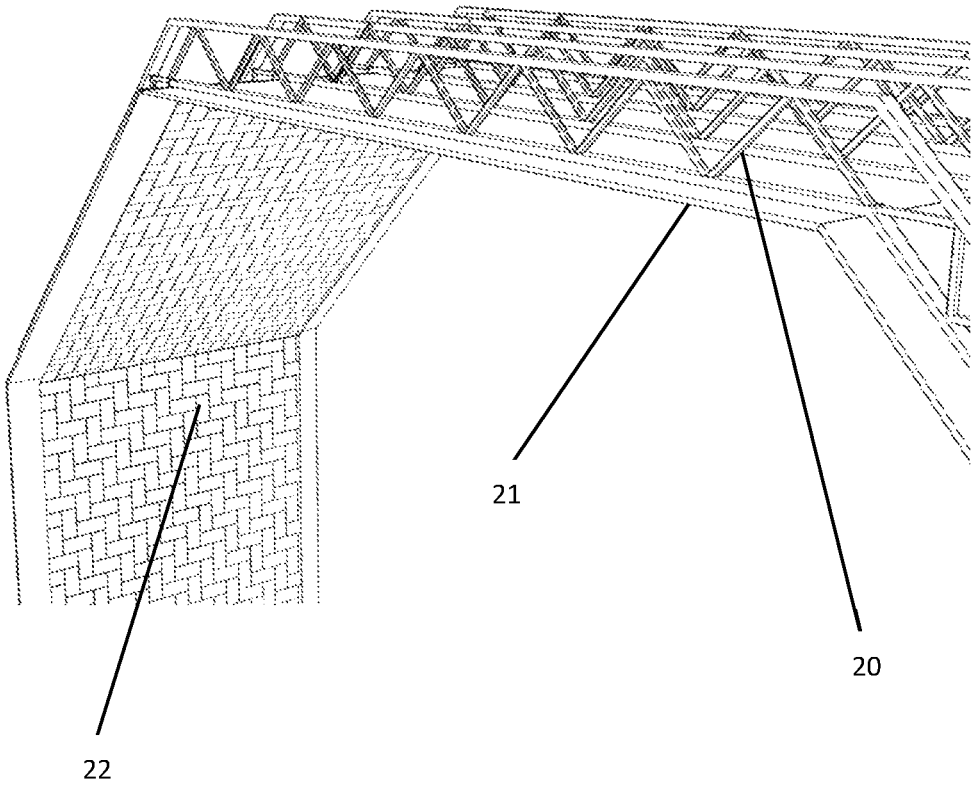
FIG. 3*a* illustrates details of another example of embodiment of the present invention.

FIG. 3*a* illustrates how a wall part of the tank wall comprising the spacer elements 20 and wooden wall elements 21 illustrated in FIG. 2 may be assembled providing an assembled tank wall. As can be seen from FIG. 3*a,* the spacer elements 20 constitute a plurality of parallel beam lines spaced apart around the periphery of the tank. Double plated steel membrane elements 22 are assembled into a continuous leakage free membrane attached or located adjacent to wooden wall elements 21 as discussed above being supported by the spacer elements 20.

Figure 3B:
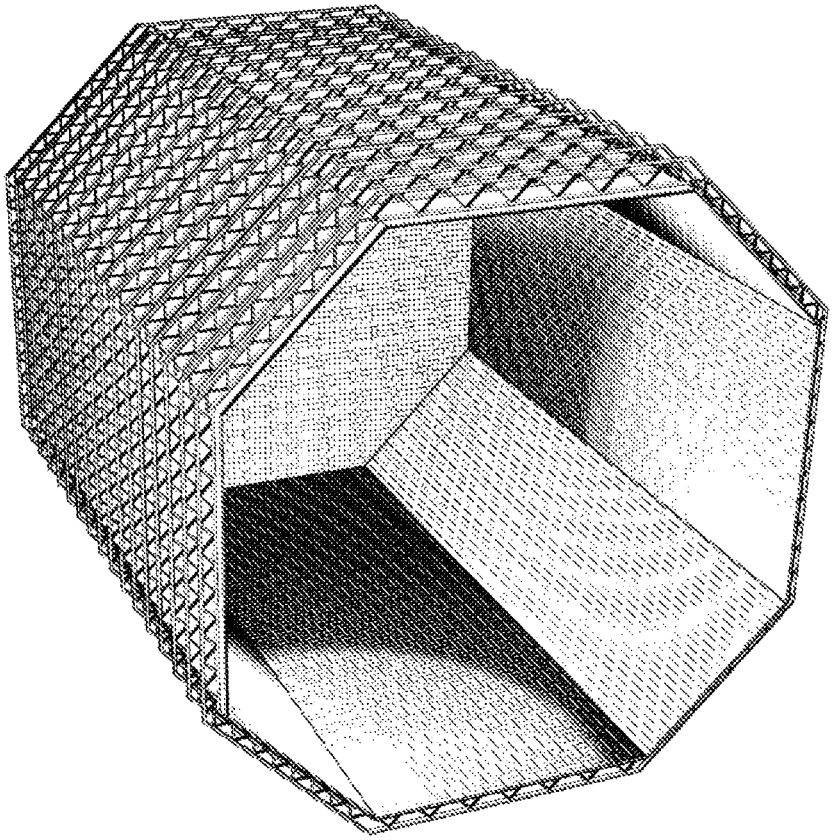
FIG. 3*b* illustrates further details of the example of embodiment in FIG. 3*a*.

FIG. 3*b* illustrates a perspective view when looking into the interior of an example of a tank assembly illustrated in FIG. 3*a*.

Figure 3C:
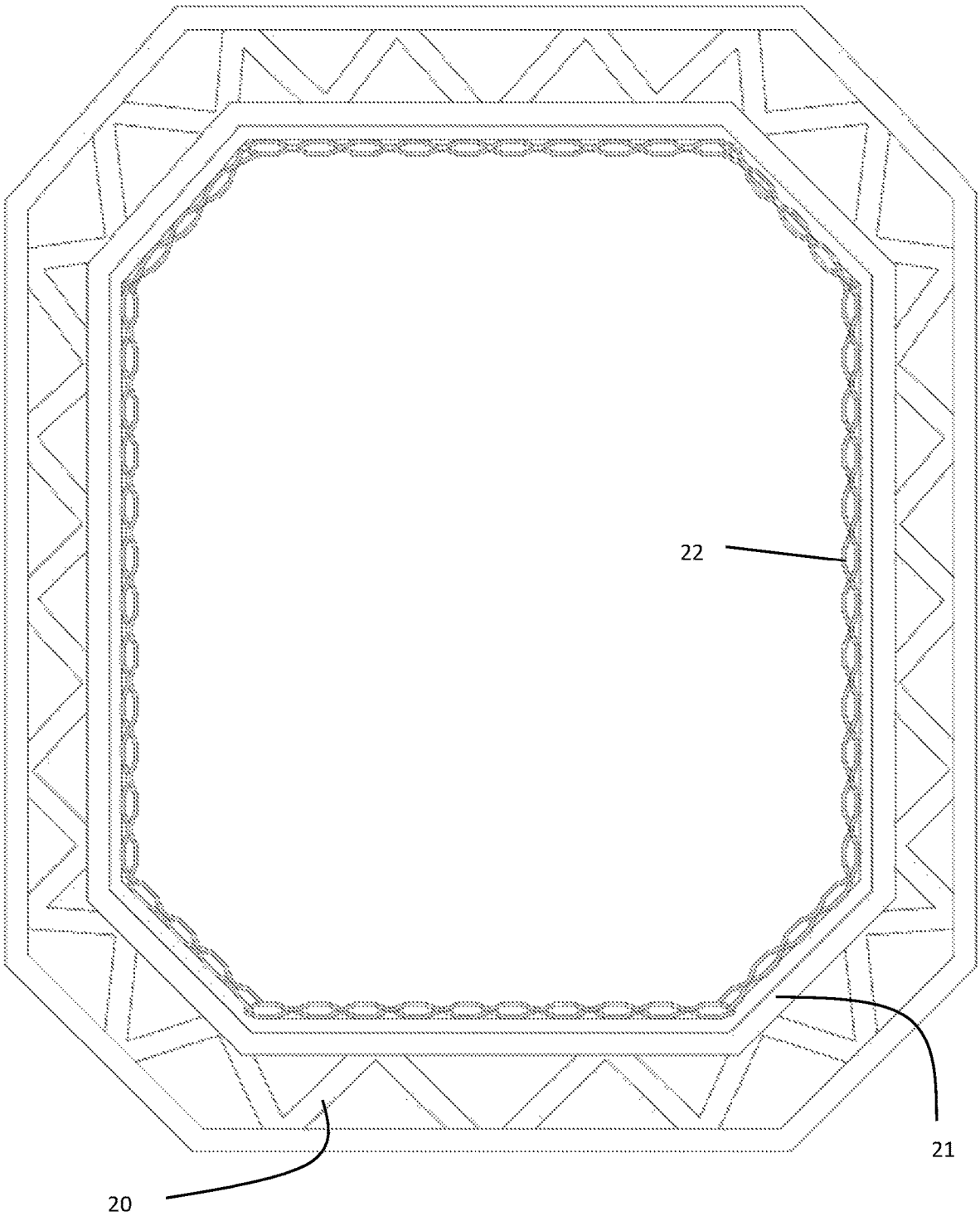
FIG. 3*c* illustrates further details of the example of embodiment in FIG. 3*a*.

FIG. 3*c* illustrates a cross sectional view of the example of tank assembly illustrated in FIG. 3*b* illustrating the relationship between the spacer elements 20, the wooden wall elements 21 and the membrane 22.

When wooden wall elements 21 are assembled into larger parts of a LNG tank wall, respective wooden wall elements 21 are for example arranged with tongues and grooves which can be glued together and is forming a wall that can sustain fluid leakage. Alternatively, edges of the wall elements may be fitted with wooden fingers being cut out of the wooden wall element. When assembling respective wooden wall elements, the protruding fingers of a first wall element is inserted into the space between the protruding fingers of a second joined wooden wall element, and vice versa. Further, the wooden wall elements can also be fitted with a coating improving the leakage property of the wooden wall elements 21 of the LNG tank wall.

Corrugated stainless steel plates of a membrane element according to the present invention may in principle be of any practical size. For example, the stainless steel plates may be rectangular plates of lesser dimensions being welded together when a tank wall is assembled. FIG. 4*a* illustrates an example of assembling a membrane constituted by corrugated stainless steel plates welded together. The membrane is facing towards the interior storage space of the tank and will be in direct contact with LNG when the tank is filled with LNG.

With reference to FIG. 4*a,* the membrane element 22 is constituted by two corrugated stainless steel plates facing each other and are welded together in selected contact points. A first steel plate 60 is larger in surface area than a second steel plate 63 but have the same form factor (for example rectangular). The first steel plate 60 and the second steel plate are arranged with a plurality of indents 62 constituting corrugation elements of the steel plates. In the example depicted in FIG. 4*a* the indents 62 are for example shaped as hemispheres. When assembling the tank wall, the larger first steel plate 60 is attached or located adjacent to the wooden wall element 21 as discussed above, wherein the protruding part of the corrugation elements are protruding outwardly from the wooden wall element 21 towards the interior of the LNG tank. A second corrugated steel plate 63 is welded on top of the first steel plate 60. The welding step of the steel plate 63 on top of the steel plate 60 may be done separately, for example at a factory. The protruding part of the corrugation elements 62 of the second steel plate 63 is facing towards the protruding parts of the corrugation elements 62 of the first steel plate 60. The steel plates are welded together face to face in respective selected joined top points or surfaces of the respective protruding corrugation elements facing each other. Thereby, a space is constituted between the first steel plate and the second steel plate around the joined protruding corrugation elements of the first and second steel plates 60, 63.

A technical effect of the double plated membrane according to the present invention is that the membrane will exhibit viscoelasticity properties, i.e. the membrane will exhibit both viscous and elastic characteristics when undergoing deformations. It is known that viscous materials resist shear flow and strain linearly as a function of time when stress is applied. Elastic materials being stretched will return quickly to their original state when the stress is removed. These effects of the double plated membrane according to the present invention are beneficial when the double plated membrane is subject to thermal induced stress. The membrane itself has proven to be able to reduce transfer of forces due to thermal expansion/reduction from thermal impact from cryogenic fluids being filled or removed from the interior of the tank. Other phenomena like shlushing and slamming (discussed below) as known in prior art is also handled well by the double plated membrane.

In the example above, two bolts 61 are welded onto the side surface of the first steel plate 60 facing towards the wooden wall element 21 without penetrating any of the two steel plates. The example is illustrated in the left hand located cross sectional side view in FIG. 4*a*. Then the surface of the first steel plate 60 welded together with the second steel plate 63 are constituting a complete double plated membrane element without any holes at all.

Figure 4B:
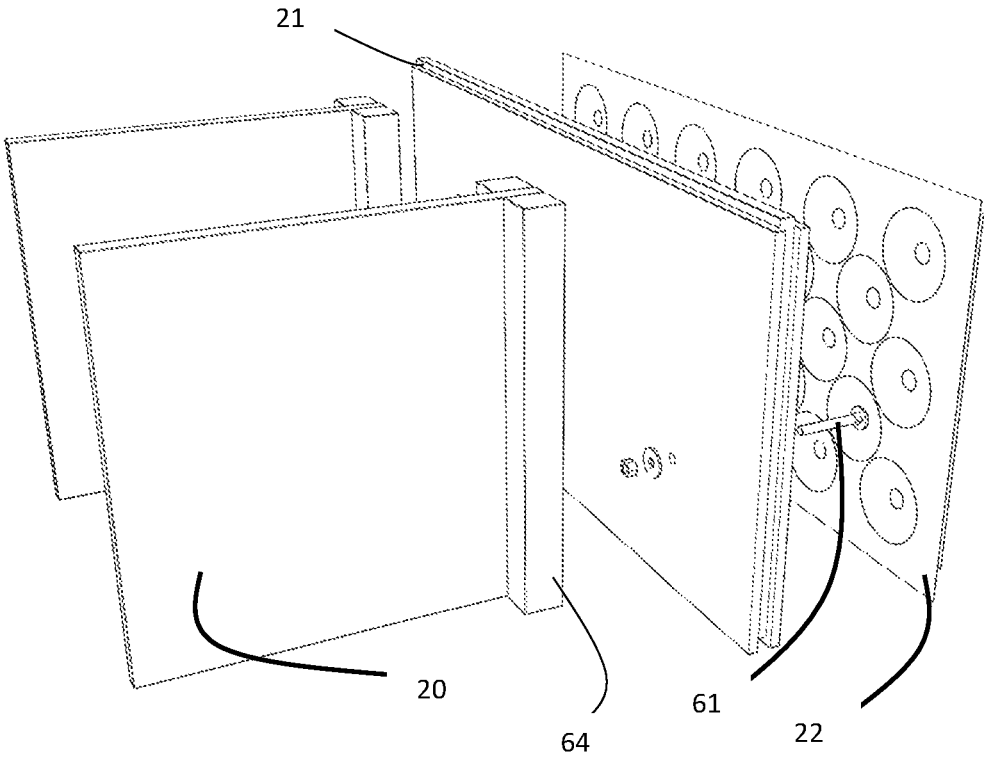
FIG. 4*b* illustrates further details the example in FIG. 4*a*.

FIG. 4*b* illustrates another example of spacer elements 20 constituted by wooden plates being attached to the side surface of the wooden wall element 21 facing towards the mechanical support structure (not illustrated). Bolts 61 are attached to the first membrane plate 60 of the membrane element 22 and the wooden wall element 21 as discussed above.

With reference to FIG. 4*b,*in an example of embodiment of the present invention, the spacer elements can be attached to brackets (not illustrated) attached to the inner wall of the mechanical support structure (not illustrated) before an assembled membrane element is attached to the spacer elements. The assembled membrane element may be assembled by first welding a first corrugated steel plate 60 to a second corrugated steel plate 63 as discussed above. Bolts 61 are welded to the joined assembly of the double plated membrane elements as discussed above. Then the bolts 61 can be inserted through corresponding holes arranged in the wooden wall element 21 and secured by fastening the bolts with for example nuts.

Figure 4C:
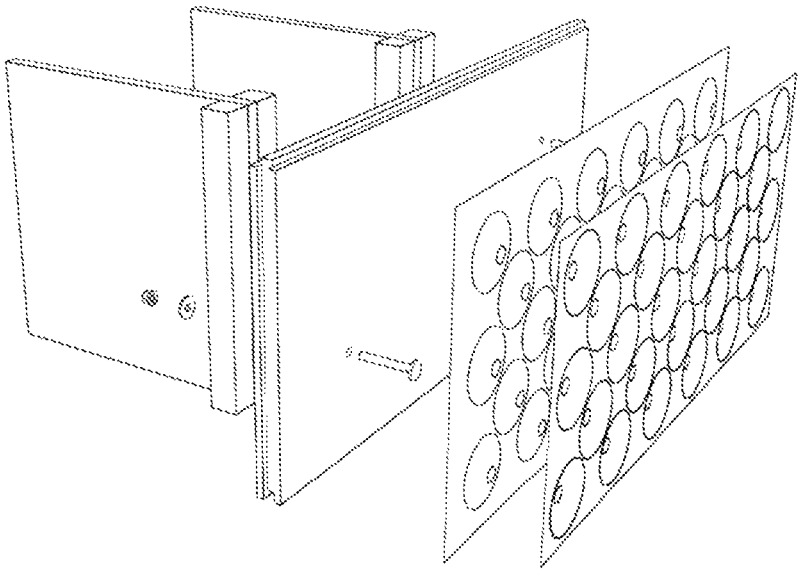
FIG. 4*c* illustrates further details of the example in FIG. 4*a*.

FIG. 4*c* illustrates the example disclosed in FIG. 4*b* viewed from a different angle.

The assembled membrane element including the wooden wall element are attached to the spacer elements 20. For example, as disclosed in FIG. 4*b*, the end part of the plates being used as spacer elements 20 can be arranged with a wooden bracket 64 on end surfaces of the wooden spacer element 20 facing towards the wooden wall element 21, and be attached to the wooden wall element 21 with bolts. For example, the bolts 61 attached to the first steel plate 60 can be prolonged to pass through the wooden bracket 64, and the nuts as discussed above can be used to fasten the whole arrangement securely to the spacer elements 20.

Figure 5A:
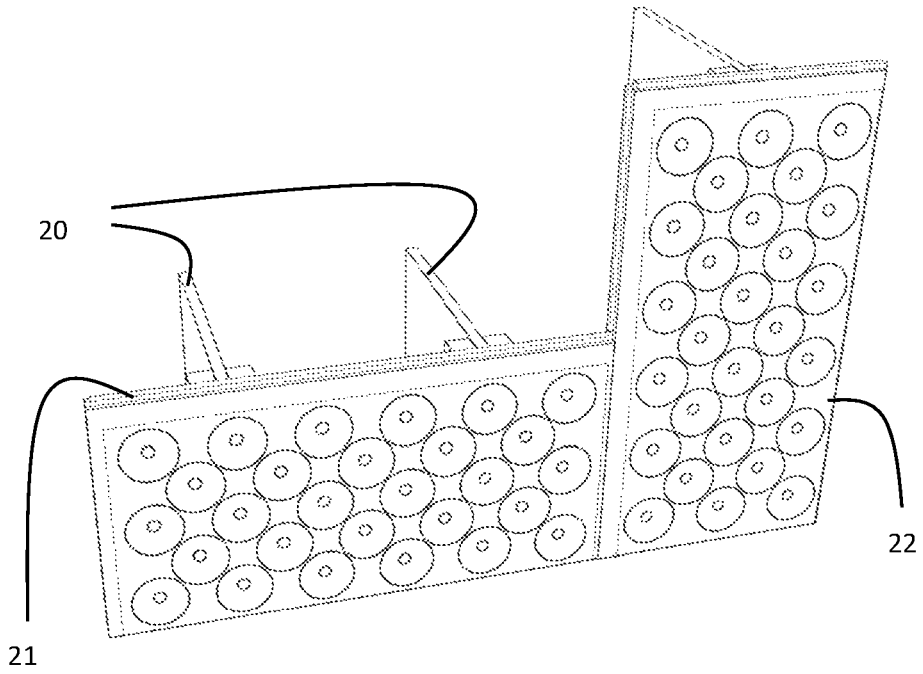
FIG. 5*a* illustrates details of another example of embodiment of the present invention.
Figure 5B:
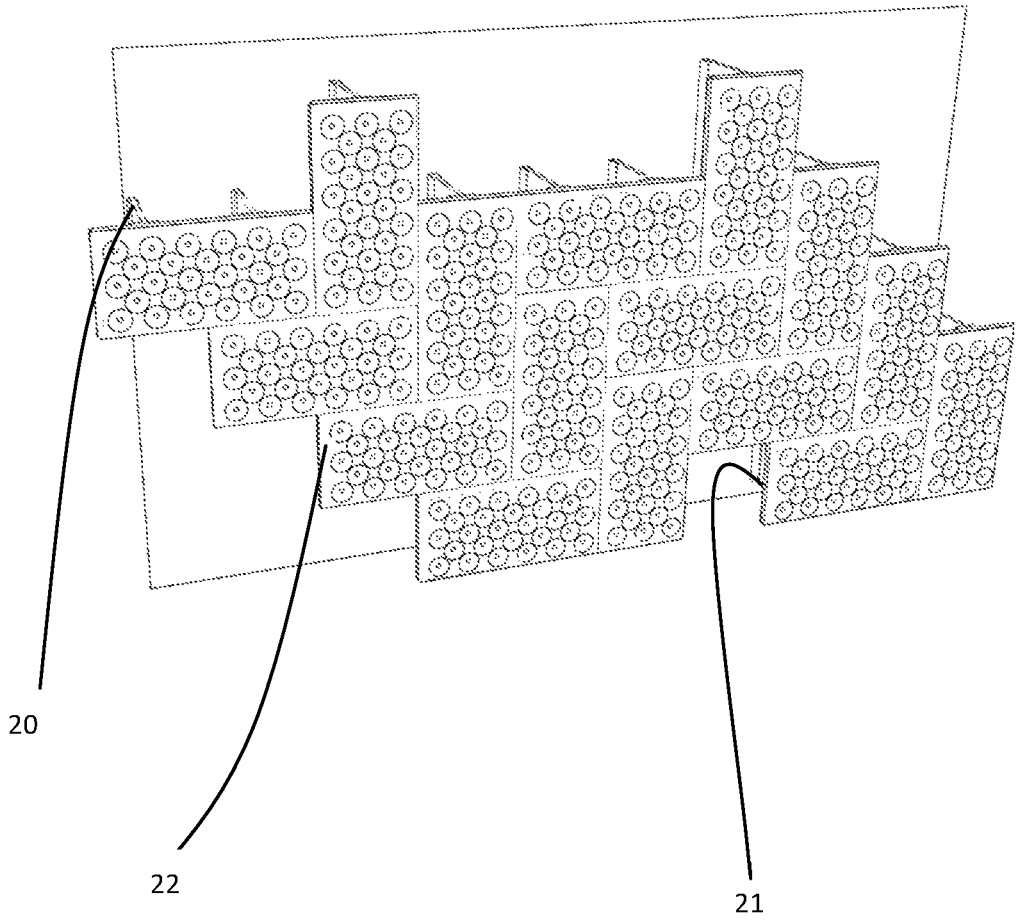
FIG. 5*b* illustrates further details of the example in FIG. 5*a*.

FIG. 5*a* illustrates an example of assembling two adjacent membrane elements 22 into a part of the membrane of the LNG tank wall, while FIG. 5*b* illustrates a larger wall segment wherein membrane elements 22 are joined together in a herringbone pattern. The longitudinal side of the rectangular shaped membrane elements (22) may have a length being twice the length of the width of the rectangular shaped membrane elements (22).

Figure 6A:
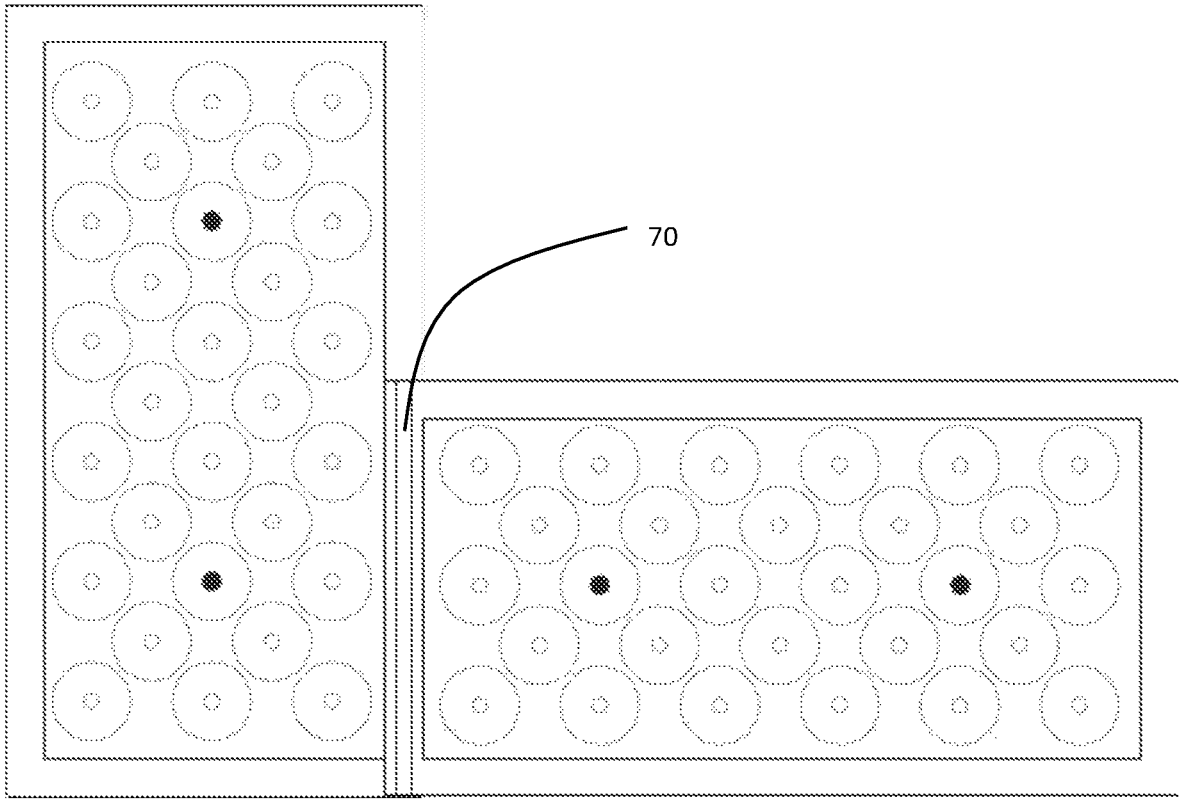
FIG. 6*a* illustrates further details of an example of embodiment of the present invention.

When assembling adjacent membrane elements 22 into larger wall segments as illustrated in FIG. 5*a* and FIG. 5*b*, the respective first 60 and second 63 steel plates of a double plated steel membrane must be welded together. FIG. 6*a* illustrates how two adjacent first steel plates 60 of two adjacent membrane elements are welded together with a splicing plate 70 overlapping respective adjacent edge surfaces in a staring herringbone pattern as illustrated in FIG. 5*a*. As discussed above the size of the first steel plate 60 is larger than the size of the second steel plate 63. The effect is that when two membrane elements are located adjacent to each other the two adjacent second steel plates 63 of the membrane element 22 will be apart with a larger distance than the first steel plates 60. Then there will be an opening between adjacent second steel plates 63 providing access to the first steel plates 60 thereby making it possible to weld together the two adjacent first steel plates 60 with the splicing plate 70.

Figure 6B:
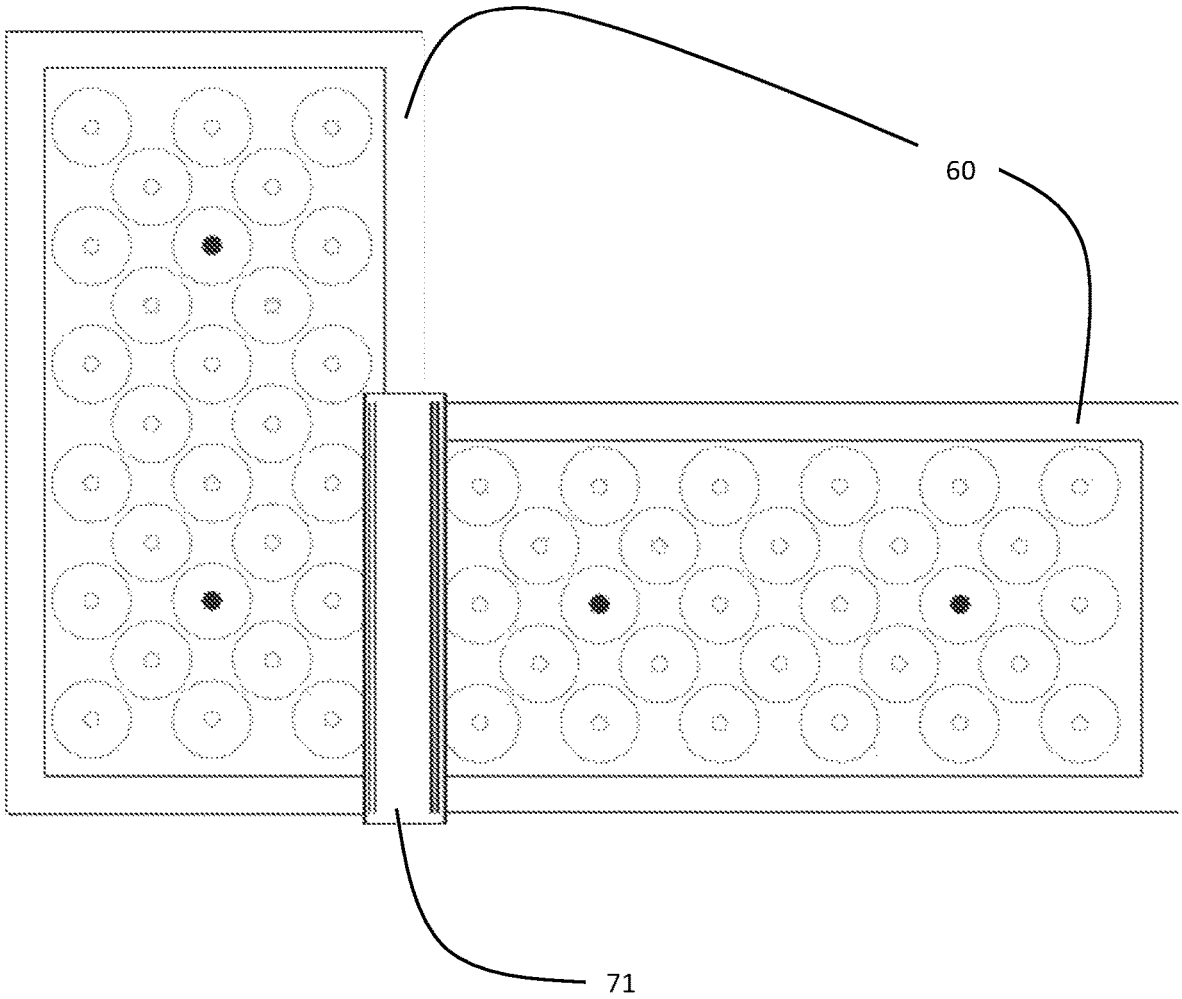
FIG. 6*b* illustrates further details of the example in FIG. 6*a*.
Figure 6C:
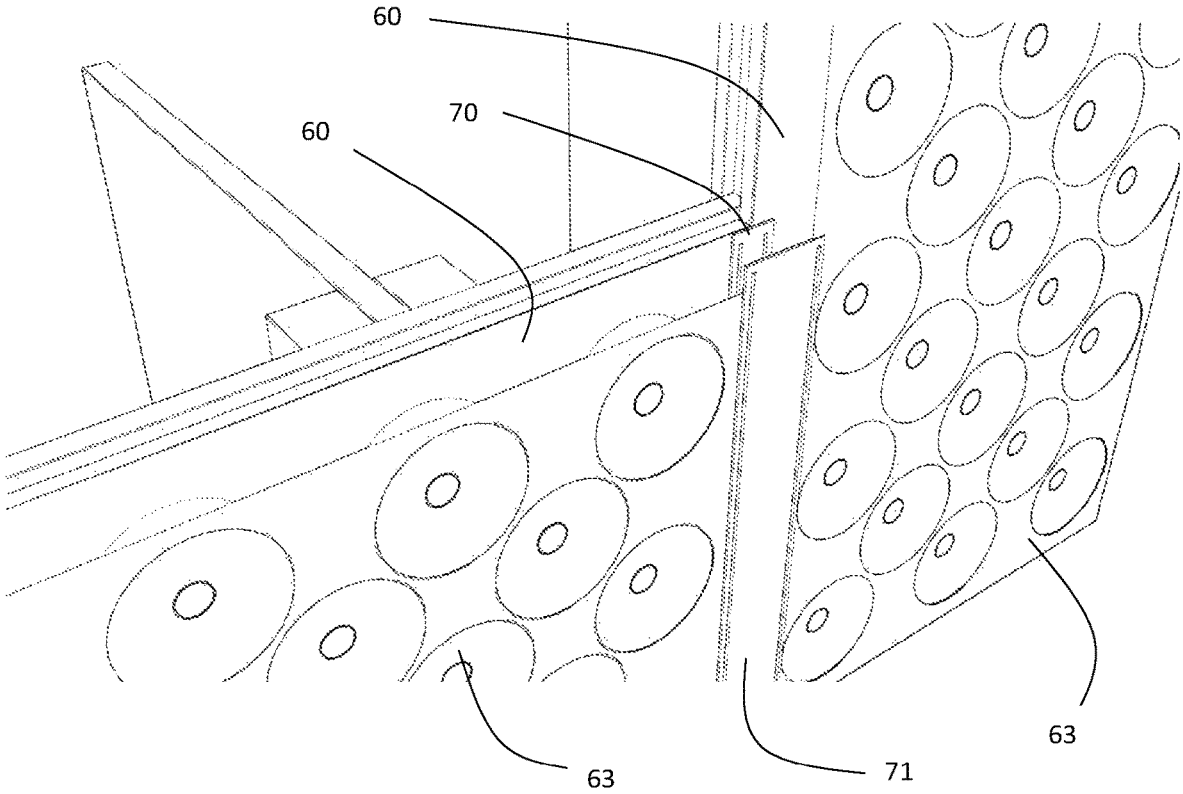
FIG. 6*c* illustrates further details of the example in FIG. ba.

FIG. 6*b* illustrates how a larger splicing plate 71 can be used to weld together two adjacent second corrugated steel plates 63. FIG. 6*c* disclose a perspective view illustrating the relationship between the two splicing plates 70, 71 and the respective first and second corrugated steel plates of two adjacent membrane elements.

The splicing plates 70, 71 may be arranged with corrugation elements. Then it is possible to use other patterns when assembling a tank wall(s) according to the present invention. For example, a brick pattern.

The above referenced illustrations of non-limiting examples of embodiments of the present invention are illustrated with for example two bolts attaching a membrane element 22 to a wooden wall element 21. The steel plates used in respective embodiments of the present invention is of the steel quality 304 or similar known to have preferable qualities in cryogenic applications. However, the strength of the membrane may be an issue dependent on the application of a LNG storage tank according to the present invention. The strength is not only dependent on the steel quality of the membrane but can be adapted to environmental conditions by adjusting the number of fastening bolts used per membrane element and the number of spacer elements 20 that are used. For example, if the mechanical support structure is a ship hull, the LNG content of the storage tank will slosh around providing a slamming condition of LNG towards the side walls of the tank. The forces of the slamming are known to be able to damage LNG tank walls.

Figure 10:
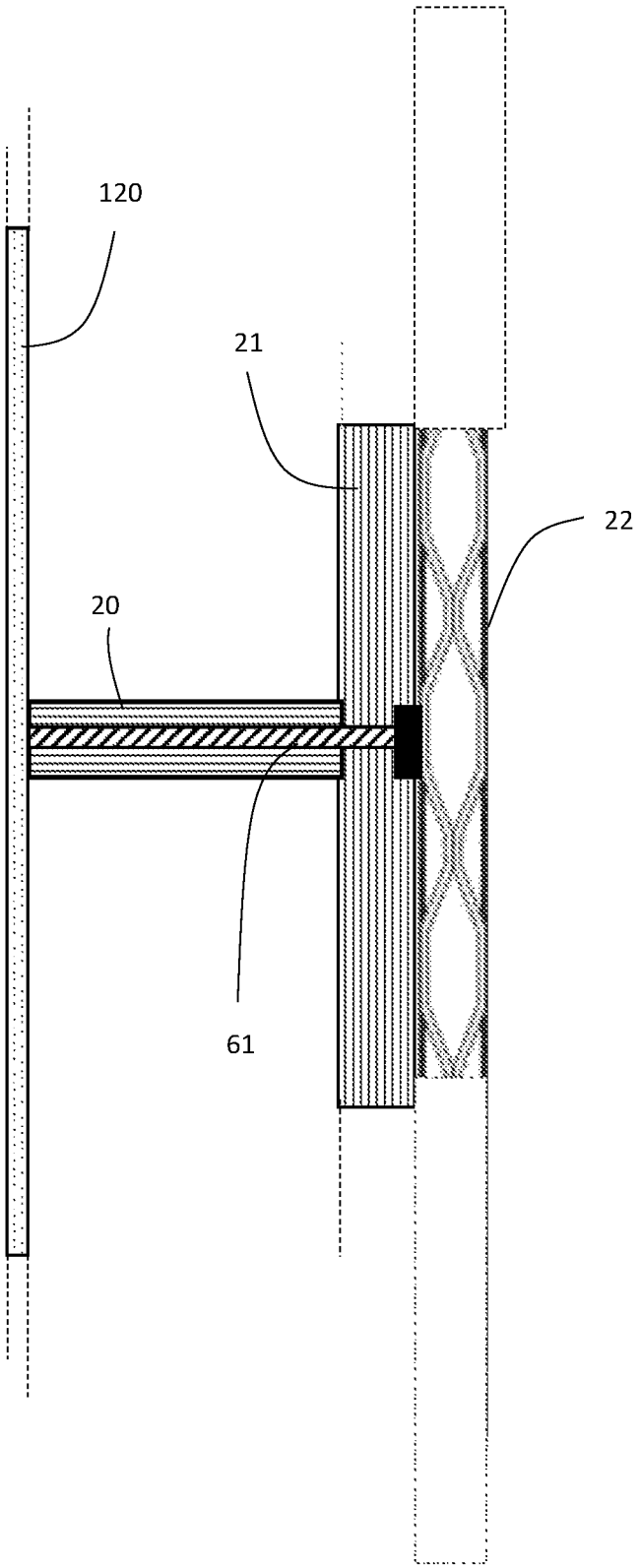
FIG. 10 illustrates a further example of embodiment according to the present invention.

FIG. 10 illustrates another example of assembling a membrane element 22, a wooden wall element 21 and spacer elements 20 in contact with a mechanical support structure 120. In the illustrated example the mechanical support structure 120 may be the side surface of a hull of a ship.

In the illustrated example in FIG. 10, the bolt 61 is welded onto the surface of the membrane element 22 facing towards the wooden wall element 21. The bolt 61 is extended to pass all the way through the body of the spacer elements 20 such that the end of the bolt being located opposite the welded part of the bolt 61 is facing in direct contact with the inner wall of the mechanical support structure 120, for example the steel walls of a ship. The bolt 61 may be welded to the inner steel surface of the ship's hull. When the membrane of the LNG tank is cooled down due to filling of a cryogenic cold fluid, the outer shape of the membrane will shrink as known to a person skilled in the art. Then any forces due to thermal induced stress in the double plated membrane attached to the bolts 61 are passed through to the backside of the LNG tank constituted by the mechanical support structure of the tank. Then the arrangement illustrated in FIG. 10 would transfer any induced stress onto the ship's hull instead of directly to the wooden wall element via the bolt 61. Then the integrity of the wooden part of the tank wall(s) will be preserved. The same effect is achieved when sloshing or slamming appears inside the tank as discussed above.

Figure 11:
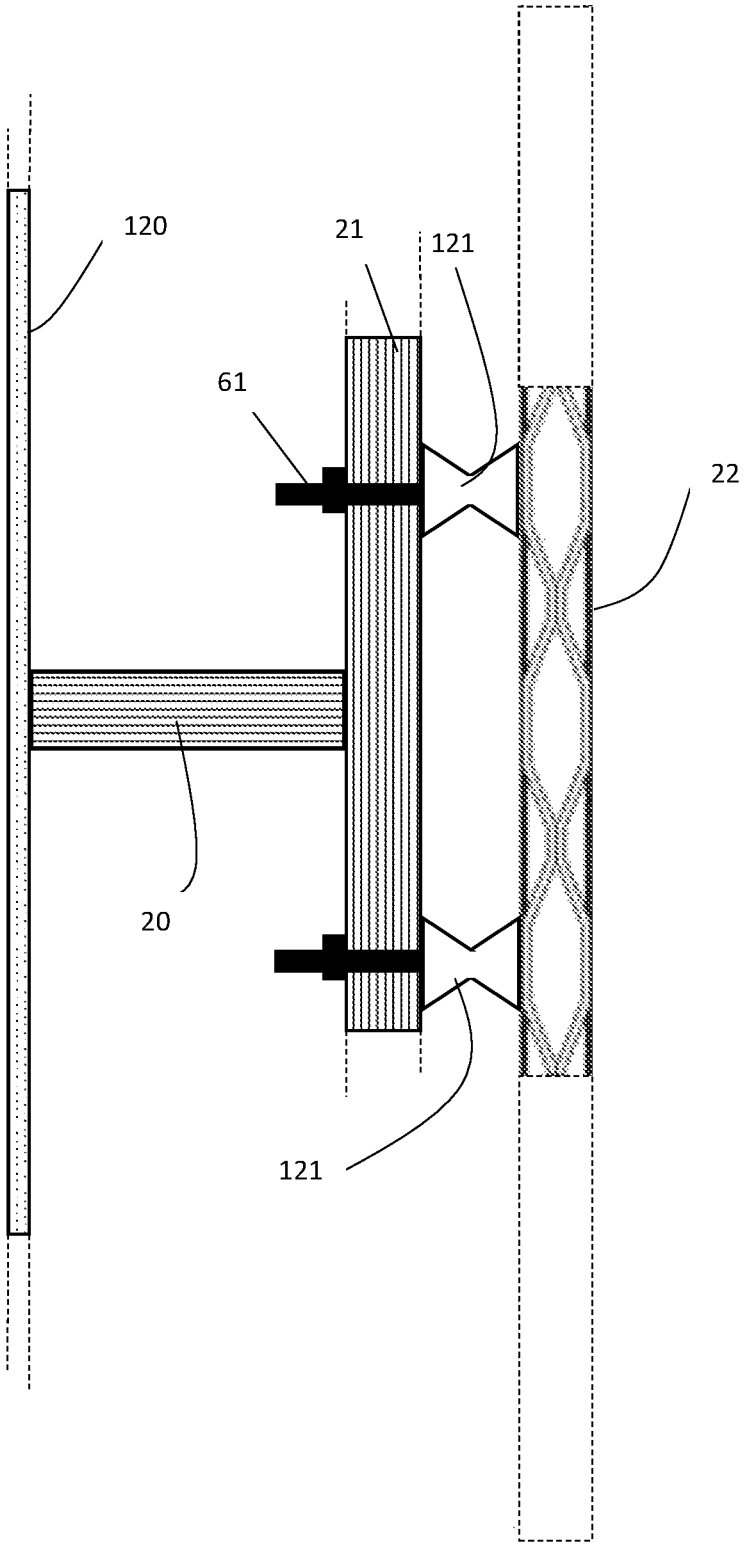
FIG. 11 illustrates a further example of embodiment of the present invention.

FIG. 11 illustrates an example of a different solution when reducing transfer of forces between the membrane and the wooden wall of a LNG tank according to the present invention. Instead of attaching a membrane element 22 directly with bolts to the wooden wall element 21, a corrugation element 121 in the shape of a bellow like structure is inserted in between the membrane element 22 and the wooden wall element 21. A first end of the bellow like element 121 is welded to the surface of the membrane element facing towards the wooden wall element 21. A second end, opposite the first end, of the bellow like element 121 is attached to the wooden wall element 21 with bolts 61 and fastened with nuts on the other side of the wooden wall element 21.

When thermal induced shrinking of the shape of the membrane of the LNG tank takes place, the bellow element 121 will start to stretch, and the work done by the thermal induced forces is used to stretch the bellow like structure thereby avoiding or at least reducing substantially the transfer of forces to the wooden wall element 21.

When building a tank according to the present invention, a plurality of bellow like elements 121 are used in embodiments using the bellow like element. The bellow like element 121 functions as a corrugation element.

Figure 12:
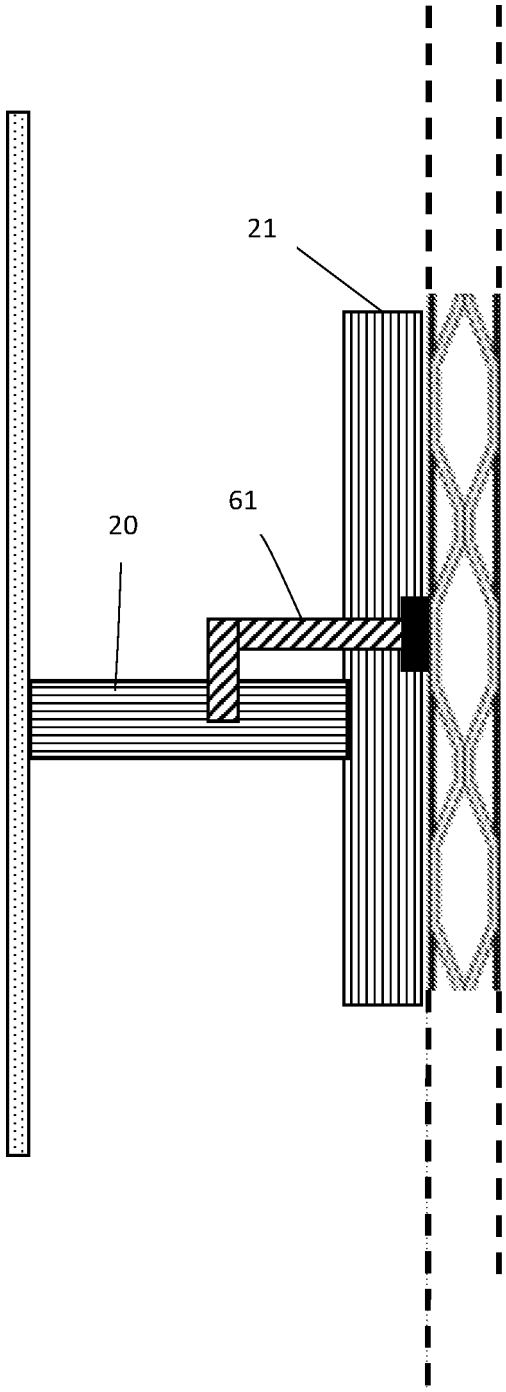
FIG. 12 illustrates a further example of embodiment of the present invention.

FIG. 12 illustrates a further alternative embodiment of the present invention, wherein the bolt 61 is arranged as a L shaped rod, wherein the shortest part of the L shaped rod is protruding vertically out from the longer part of the L-shaped rod, and is attached to a top surface (or side surface) of the wooden spacer element 20. The beneficial effects provided by a wooden spacer element in contact with for example a twisting or moving ship side is kept in addition to the fact that the L shaped connection to the wooden spacer element 20 transfer at least most of forces induced on the surface of the double plated membrane passed the wooden wall element(s) 21 onto the spacer element on the backside of the wooden wall element(s) 21.

It is within the scope of the present invention to use any arrangement that stops or significantly reduces transfer of forces between the double plated membrane and the wooden support structure in examples of embodiments of the present invention.

An aspect of the present invention is that the strength of a LNG storage tank according to the present invention is controllable and achievable by the following features:

- The steel quality 304 provides a softness and steel quality that enables stretching off steel plates within known limits without the steel plates to be teared apart.
- The mechanical movements of steel plates due to thermal expansion and contractions are mitigated by corrugation elements provided on the respective steel plate surfaces of the membrane elements.
- The mechanical integrity of membrane elements can further be enhanced by increasing the number of fastening bolts attaching respective membrane elements to the wooden wall elements, to the spacer element or directly to the mechanical support structure.
- The area of the membrane surface between bolts are still enabled to mitigate thermal induced stress in the steel plates by corrugations in the surrounding of the respective fastening bolts.
- The wooden elements of the design is capable of withstanding twisting and stretching of the walls of the tank.
- The transfer of forces between the double plated membrane, the wooden wall elements and the mechanical support structure is controllable, and especially any transfer of forces between the wooden wall elements and double plated membrane elements can be eliminated, or at least be reduced significantly.

Respective different corrugation elements can be arranged on surfaces of the first steel plate 60 and the second steel plate 63 of a membrane element 22. Respective different possible patterns may have different abilities to mitigate induced thermal stress. For example, the pattern may mitigate differently or symmetrically dependent on the direction of forces working on the surface. The number of corrugation elements on the surface will also provide different abilities to mitigate thermal induced stress. The shape of the corrugation elements does also play an important factor. In a sense, the ability of a corrugation element to mitigate thermal induced stress and mechanical stress as well (for example from slamming as discussed above) is the number and size of folding edges. All these possibilities make it possible to adapt steel plates of a membrane element according to the present invention to a plurality of application areas as well as different environmental requirements.

Figure 7A:
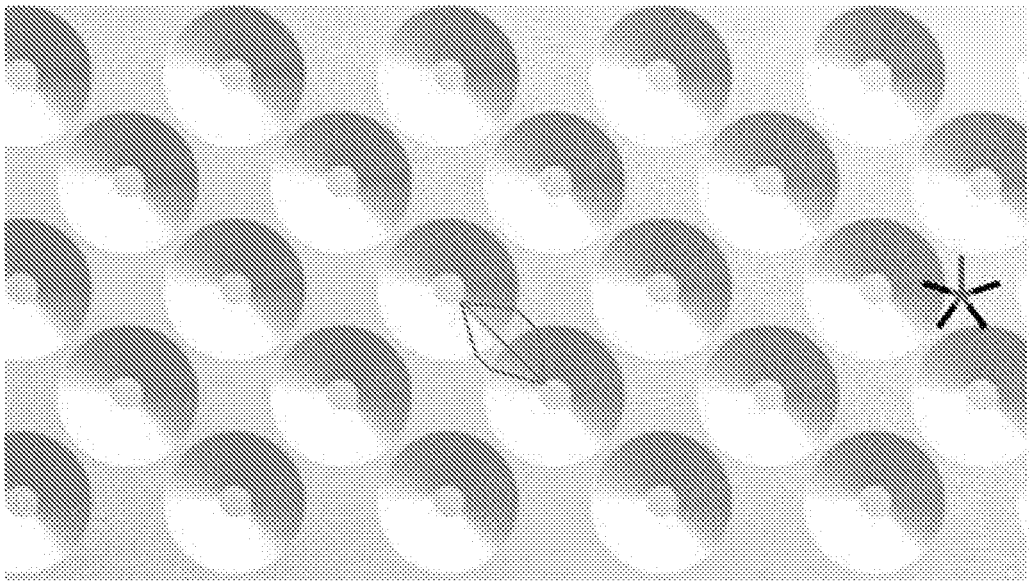
FIG. 7*a* illustrates details of a steel plate of an example of embodiment of a membrane element according to the present invention.

FIG. 7*a* illustrates a pattern of corrugations made of protruding cones. The distance between adjacent cones are smaller along diagonal lines compared to the horizontal and vertical direction. This implies that the pattern is more capable of mitigating stress forces in the diagonal directions than in the other directions.

Figure 7B:
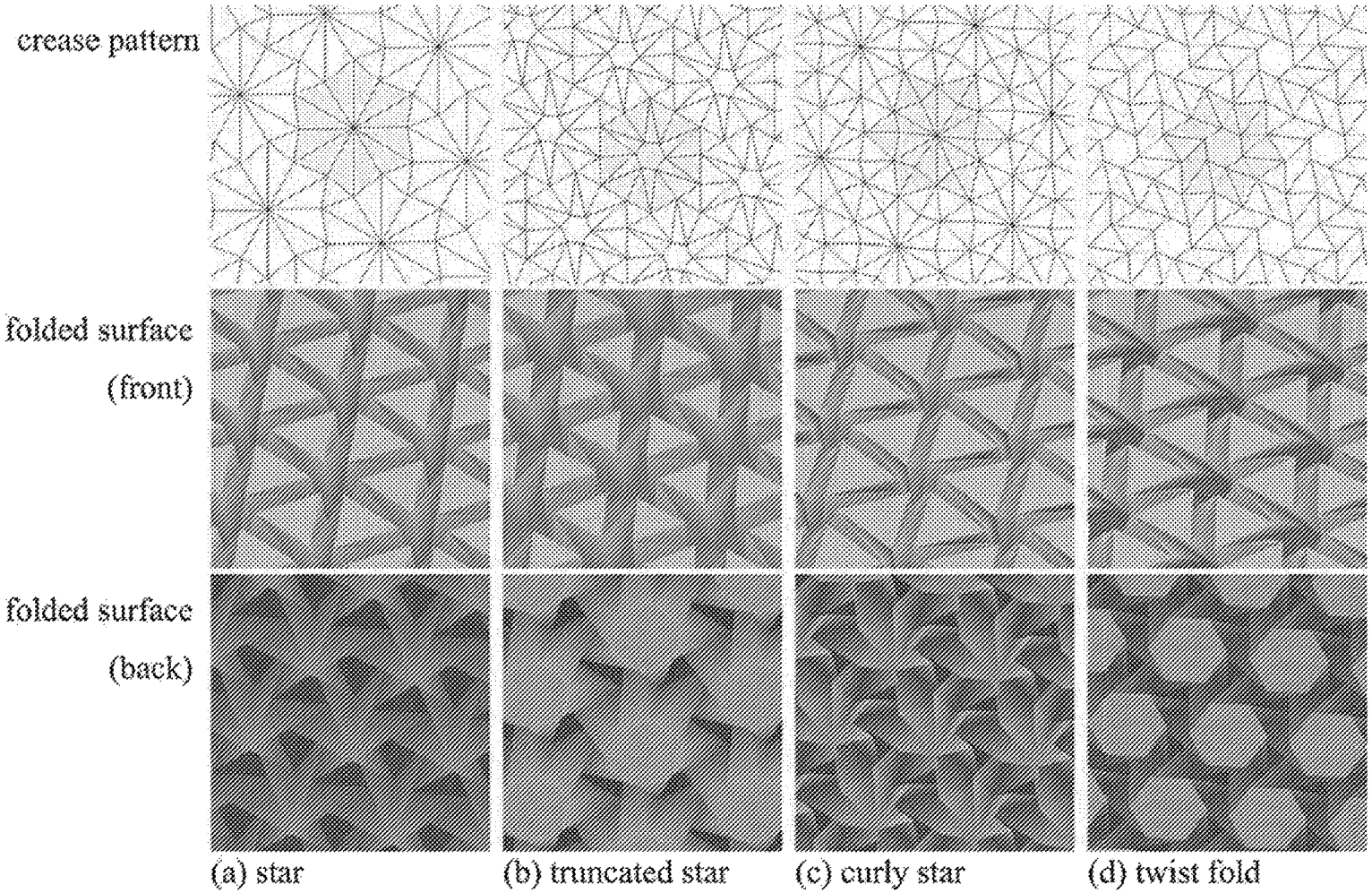
FIG. 7*b* illustrates further example of a steel plate of respective embodiments of a membrane according to the present invention.

FIG. 7*b* illustrates some examples of possible shapes and patterns of corrugations according to the present invention. The illustration is in two dimension wherein the vertical left hand column represents a starting pattern of respectively a creased pattern and folded surface pattern viewed from the backside of the pattern as well at the bottom as viewed from the front of the pattern. The respective columns on the right-hand side of the drawing illustrates first (a) a star pattern, (b) a truncated star pattern, (c) a curly star pattern, and (d) a twist fold pattern.

Figure 7C:
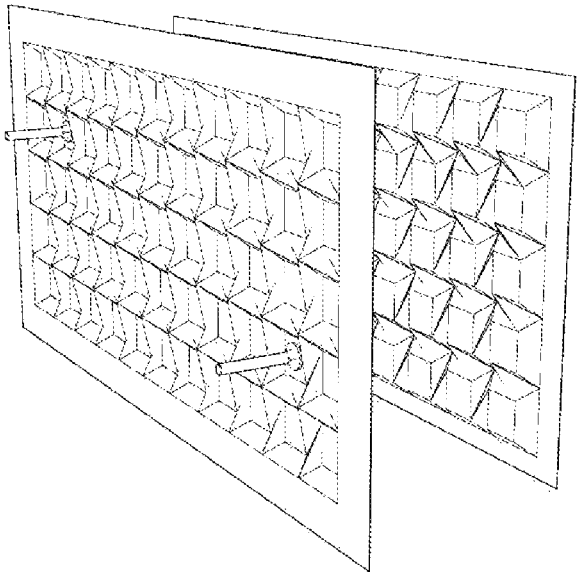
FIG. 7*c* illustrates a further example of an embodiment of a membrane according to the present invention.

FIG. 7*c* illustrates how one of the patterns can be arranged on two steel plates of a membrane element 22.

Figure 7D:
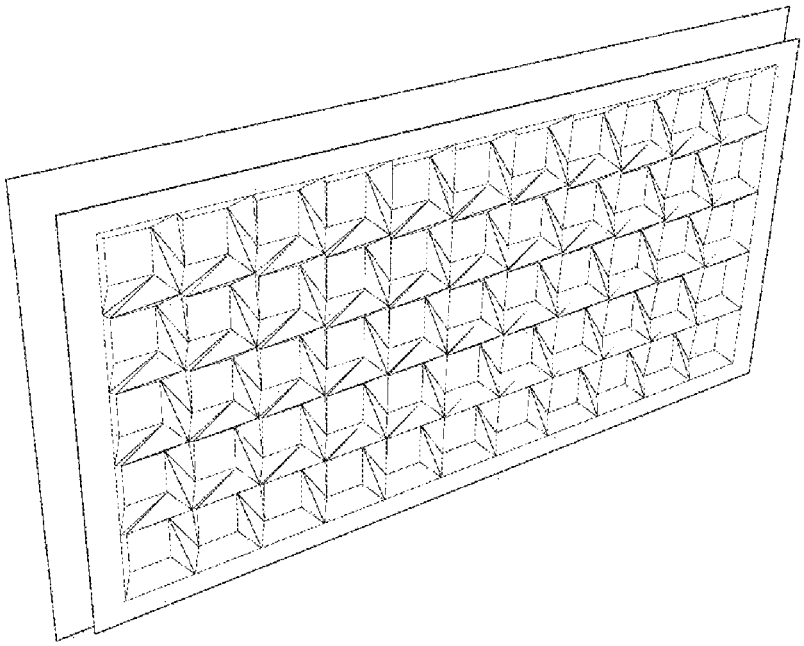
FIG. 7*d* illustrates a further example of embodiment of a membrane according to the present invention.

FIG. 7*d* illustrates the assembled membrane element disclosed in FIG. 7*c*.

Thermal insulation is part of the LNG tank design according to the present invention. The space between the inner surface of the mechanical support structure and the wooden wall elements 21 constituted by the spacer elements 22 can be filled with an insulating material. The obtainable strength of a design according to the present invention makes it also possible to provide a near vacuum condition in the insulation space, for example together with traditional insulation like perlite.

The effect of vacuum is that the insulating property of the tank increases considerably. An effect of the increased insulating effect is that the thickness of the insulating space can be reduces, i.e. the length of the spacer elements 22. This will then increase available storage volume in the order 5% to 7% compared to a tank with traditional insulation materials.

A vacuum pump assembly can be an integral part of a LNG storage tank according to the present invention.

The space constituted by respective protruding corrugation elements between the first corrugated steel plate 60 and the second corrugated steel plate 63 can be arranged with cooling channels providing means for distributing a cooling fluid around inside the membrane of the tank. An effect of this arrangement is that the known boil-off effect of LNG from storage tanks can be avoided or at least reduces considerably. This may also enable long term storage of LNG t other cryogenic fluids.

According to an example of embodiment, a cooling machine as known in prior art may be connected to an inlet channel suppling cooling fluid to the membrane while collecting used cooling fluid from an outlet channel and redistributing cooled cooling fluid around inside the membrane.

Another possible usage of the space inside the membrane is to monitor any possible leakage from the membrane. A gas or a cooling agent can be circulated with a constant pressure inside the space of the membrane. Any drop of pressure would indicate a possible leakage.

Figure 8A:
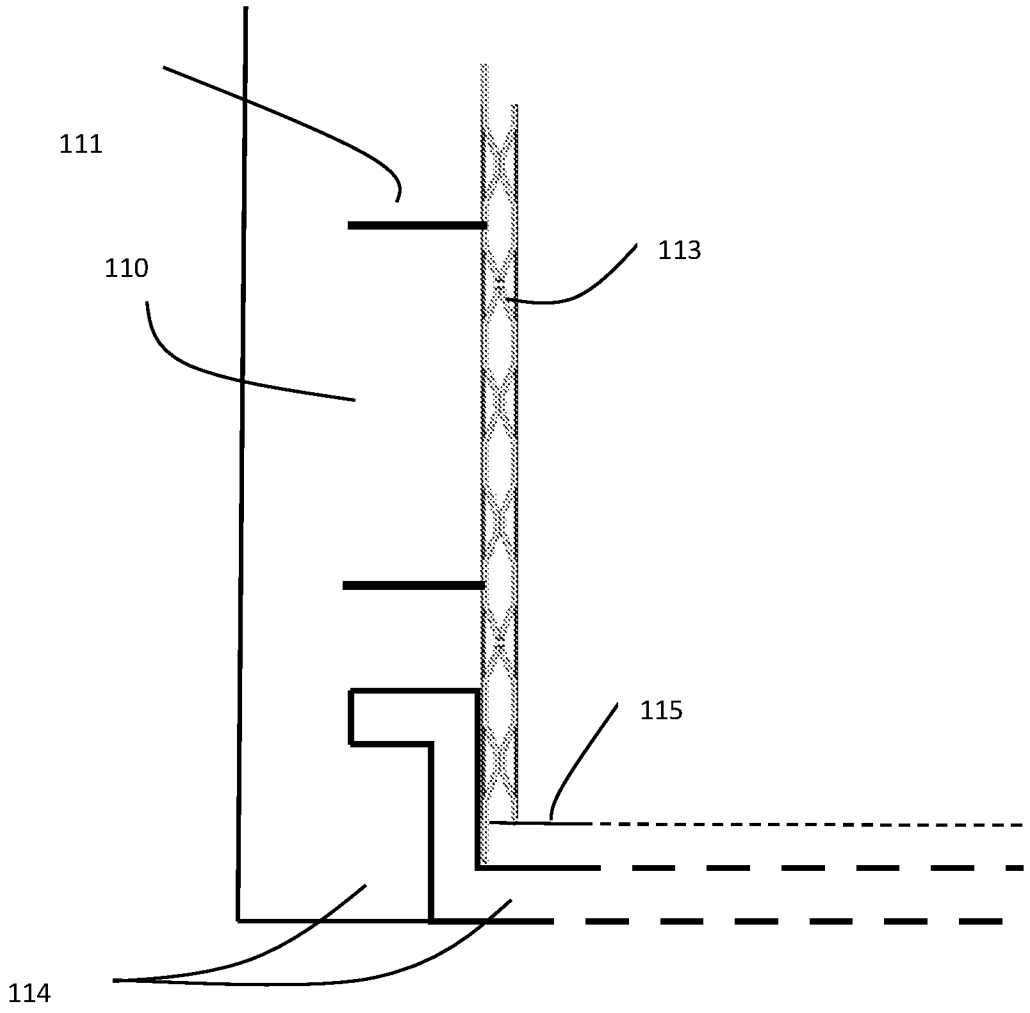
FIG. 8*a* illustrates an example of use of the present invention in an onshore based LNG tank.
Figure 8B:
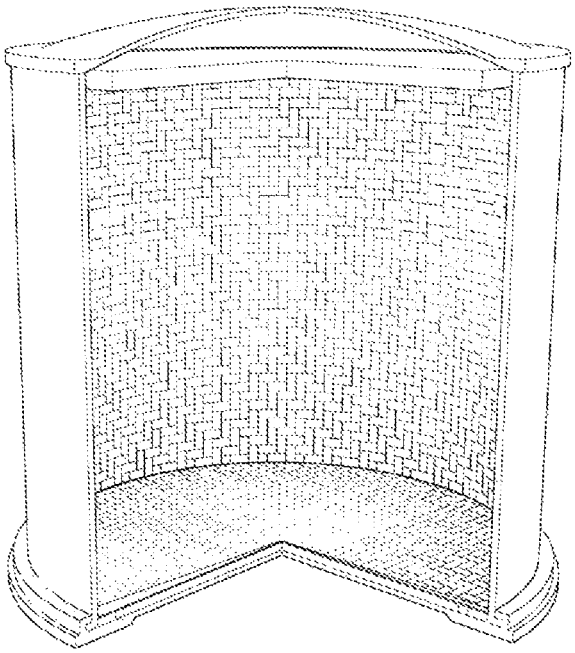
FIG. 8*b* illustrates a perspective view of the example in FIG. 8*a*.

An aspect of the present invention is that a LNG tank according to the present invention can be used in onshore LNG tank designs. FIG. 8*a* illustrate an example of a membrane 22 constituted by multiple corrugated first steel plates 60 and multiple second corrugated steel plates 63 arranged on an inside surface of a concrete wall 110. The membrane is attached to the concrete wall with bolts 61. Further, the membrane 22 is attached to a bottom 115 of the LNG storage tank. Thermal insulation can be arranged as part of the concrete wall 110 and bottom 115 as known to a person skilled in the art. The space 112 can also for example be utilized for circulating cooling gas.

Figure 9:
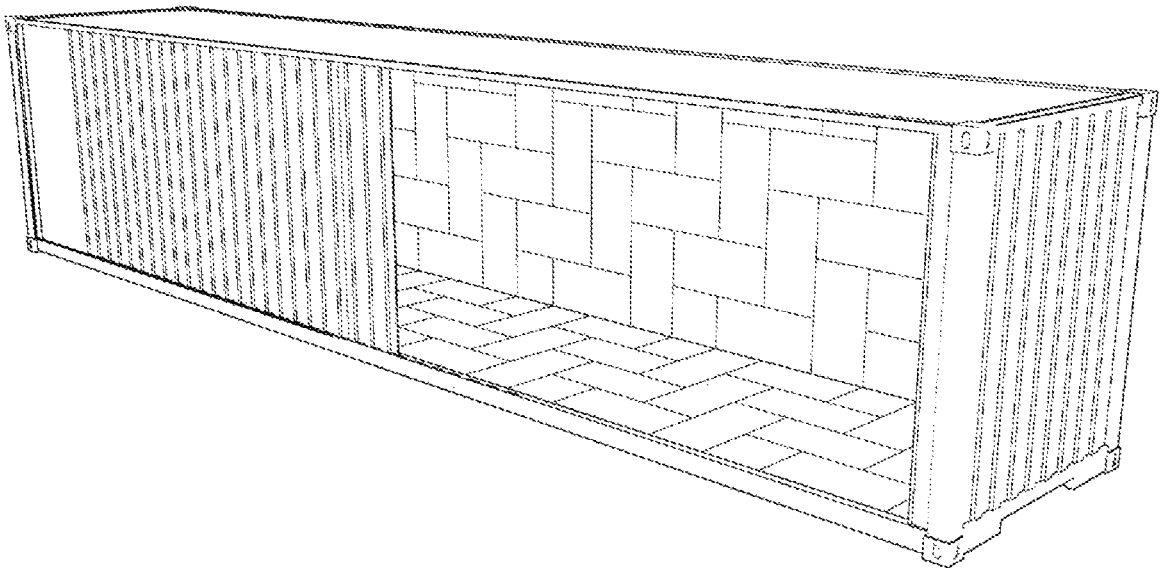
FIG. 9 illustrates an example of embodiment of the present invention in a container.

A further possible application of the LNG tank design according to the present invention is inside a standardized container as illustrated in FIG. 9. A cooling machine circulating a cooling fluid inside the membrane can be an integral part of the container, for example inside a separated room in one end of the container. Further a cooling agent may also be circulated inside the insulation space as discussed above. The benefit of such a design is that the cooling reduces the need of traditional insulation materials and thereby increases the possible storage volume inside the container. A further benefit is that long time storage of LNG is possible. Further, the boil-off effect is considerably reduced. Further, the standard form factor of containers provided cheap and effective distribution of LNG around the world inside a well-established container transport system.

Further, a container embodiment of a LNG tank facilitates distribution of LNG to consumers. For example, a supply ship can easily be adapted to transport a plurality of LNG containing containers and can then supply LNG to offshore installations as well as onshore installations etc.

Any tank application comprising a tank according to the present invention needs a fluid inlet and a fluid outlet, or a combined fluid inlet/outlet pipe. It is within the scope of the present invention to use any known prior at solution providing inlet and outlet openings of a cryogenic tank according to examples of embodiments according to the present invention.

According to an aspect of the present invention, the mechanical support structure may be built before any cryogenic tank according to the present invention is built inside the finished mechanical support structure. It is further possible to build the mechanical support structure cooperatively at the same time when building the cryogenic tank according to the present invention. It is further possible to build the cryogenic tank according to the present invention before the outer mechanical support structure is build. It may then happen that workers working on the inside of the cryogenic tank needs to climb out of the inner tank space before closing the tank wall. It is within the scope of the present invention to allow use of an escape opening as known in prior art.

It is also within the scope of the present invention to be able to arrange an inspection cover providing access to the interior of the tank when for example a validation of the integrity of the tank is necessary, for example after an accident involving the cryogenic tank.

The invention claimed is:

1. A Liquid Natural Gas (LNG) storage tank comprising an outer mechanical support structure providing a closed space housing a membrane wall of the LNG tank, wherein the membrane wall is constituted by at least the following constructional elements in order from the inner surface side of the outer mechanical support structure toward the interior storage space of the LNG storage tank:

a first end of a wooden spacer element is attached to the inner surface of the mechanical support structure, while a second end opposite the first end is attached to a backside of a wooden wall element, wherein a double plated membrane element is attached or located adjacent to a front side opposite the backside of the wooden wall element, wherein an outer surface of the double plated membrane element is facing towards the interior of the storage space of the LNG tank, the double plated membrane element is constituted by a first steel plate being arranged with a first plurality of protruding corrugation elements, and a second steel plate arranged with a second plurality of protruding corrugation elements, wherein the first steel plate is welded to the second steel plate face to face, wherein top points or top surfaces of the first plurality of protruding corrugation elements of the first steel plate is touching corresponding top points or top surfaces of the second plurality of corrugation elements of the second steel plate, wherein the welding is done by spot welding together a selected number of touching top points or top surfaces of the first plurality of protruding corrugation elements of the first steel plate touching corresponding protruding corrugation elements of the second plurality of corrugation elements of the second steel plate, the membrane element is thereby arranged with an accessible space in between the respective first and second steel plates of a membrane element, a complete tank wall supported by the outer mechanical support structure is arranged by assembling a plurality of spacer elements supporting a plurality of continuously joined wooden wall elements supporting a plurality of continuously joined double plated membrane elements, thereby forming a closed leakage free storage space of the LNG tank.

2. The LNG tank according to claim 1, wherein joining of a first membrane element to a second membrane element comprises arranging the first steel plate to have a relative larger size than the second steel plate of a membrane element, thereby there is left an opening in between the second steel plate of the first membrane element and the second steel plate of the second membrane element when the first membrane element is arranged adjacent to the second membrane element when joining the first and second membrane elements, then an edge of the first steel plate of the first membrane element is touching an edge of the first steel plate of the second membrane element and a first splicing plate is inserted through the opening between the respective two adjacent second steel plates, and is welded over the two touching surface edges of the respective two adjacent first steel plates followed by welding a second splicing plate over the adjacent edges of the respective two second steel plates, all edges of adjacent sides of joined membrane elements are correspondingly welded together uninterrupted.

3. The LNG tank according to claim 1, wherein joining a first wooden wall element to a second wall element comprises arranging edges of the wall elements with respective tongues and grooves, wherein a tongue of the first wooden wall element is inserted into a corresponding groove of the second wall element.

4. The LNG tank according to claim 3, wherein edges of wall elements are arranged with protruding fingers, wherein fingers of a first wooden wall element is inserted into corresponding spaces in between the protruding fingers of a second wooden wall element, wherein the fingers of the second wooden wall element is inserted into corresponding spaces between the fingers of the first wooden wall element.

5. The LNG tank according to claim 1, wherein respective membrane elements are attached by bolts welded to the backside of the double plated membrane elements facing towards respective corresponding wooden wall elements.

6. The LNG tank according to claim 5, wherein respective bolts are prolonged to pass through wooden wall elements and either be fastened to the inner surface of the mechanical support structure, or is attached to a top or side surface of at least one spacer element being attached to the wooden wall element supporting the membrane element.

7. The LNG tank according to claim 1, wherein the membrane wall comprising the respective constructional elements are assembled in a herringbone pattern.

8. The LNG tank according to claim 1, wherein the membrane wall comprising the respective constructional elements are assembled in a brick pattern.

9. The LNG tank according to claim 7, wherein the length of a membrane element is twice the height of the membrane element.

10. The LNG tank according to claim 1, wherein the outer mechanical support structure is the hull of a ship.

11. The LNG tank according to claim 1, wherein the outer mechanical support structure is a concrete wall of a LNG tank onshore.

12. The LNG tank according to claim 1, wherein the outer mechanical support structure is a closed container.

13. The LNG tank according to claim 1, wherein the space defined inside the respective membrane elements of a membrane wall is circulated with a cooling agent.

14. The LNG tank according to claim 11, wherein the pressure of the circulating cooling agent is monitored.

15. The LNG tank according to claim 1, wherein the wooden elements are made from liquid tight plywood.

16. The LNG tank according to claim 1, wherein air in the space defined by the spacer elements is evacuated, and the space is maintained at a vacuum pressure, or near vacuum, over time.

17. The LNG tank according to claim 16, wherein the vacuum is monitored.

* * * * *